United States Patent [19]

Burkall

[11] 3,959,891

[45] June 1, 1976

[54] REMOVABLE LINT SCREEN ASSEMBLY FOR A DRYER

[75] Inventor: Alvin Edward Burkall, St. Joseph, Mich.

[73] Assignee: Whirlpool Corporation, Benton Harbor, Mich.

[22] Filed: Dec. 30, 1974

[21] Appl. No.: 537,075

[52] U.S. Cl. ..... 34/82; 34/133; 55/501; 55/509; 55/511

[51] Int. Cl.² ..... F27B 21/06

[58] Field of Search ..... 34/82, 133, 139, 79; 55/490, 495, 500, 507, 509, 511, 529, 501

[56] References Cited

UNITED STATES PATENTS

| | | | |
|---|---|---|---|
| 3,648,381 | 3/1972 | Fox | 34/82 |
| 3,722,106 | 3/1973 | Takeyama et al. | 34/82 |

*Primary Examiner*—Kenneth W. Sprague
*Assistant Examiner*—James C. Yeung
*Attorney, Agent, or Firm*—Hill, Gross, Simpson, Van Santen, Steadman, Chiara & Simpson

[57] ABSTRACT

A low-cost internal lint screen assembly is removably mounted on a rear bulkhead of an automatic clothes dryer in an aperture through which air and lint are exhausted from the rotating drum. A plurality of locking tabs with outwardly-extending shoulders about a peripheral rim of a cover of the assembly flexibly engage surfaces of the bulkhead. Two of the locking tabs are compound tabs also having inwardly-projecting barbs which capture a flexible rim of the frame of the lint filter, the filter frame being compressed inwardly to release the filter from the cover. Also, two of the non-compound tabs may be spring metal attached to the rim, or plastic and formed integrally with the rim material.

10 Claims, 7 Drawing Figures

REMOVABLE LINT SCREEN ASSEMBLY FOR A DRYER

BACKGROUND OF THE INVENTION

1. Field of the Invention

This invention relates to removable lint screen assemblies for automatic clothes dryers.

2. Description of the Prior Art

Prior lint screen assemblies of the general configuration shown here have provided means for removably engaging an assembly to a dryer bulkhead and the lint screen filter to the cover. Such prior assemblies have been expensive to manufacture and somewhat inconvenient to use with a flange attached to the bulkhead of the dryer by multiple screws, the cover attaching to the filter by a central shaft having ears which engage a plate on the rear of the screen, and the screen attaching to the flange by single-acting spring clips.

U.S. Pat. No. 3,648,381 discloses a lint screen assembly which mounts on the inside of the door of a dryer. A filter screen in an attached circumferential frame snaplocks through a plurality of integral locking tabs with a dish-shaped perforate plastic guard to comprise the lint screen assembly, which in turn is removably snap-locked to the door of the dryer via a circular collar having a plurality of mounting legs. U.S. Pat. No. 2,925,665 discloses a lint screen assembly including a circular screen which is removably fastened to a perforate plastic disc having a resilient hub portion. The outer portion of the hub holds the screen and the inner surface of the hub removably holds the assembly to the dryer bulkhead. U.S. Pat. No. 3,722,106 discloses a removable lint screen assembly including a circular filter screen and a frame member for retaining the screen through a tapered perimeter portion.

SUMMARY OF THE INVENTION

The lint screen assembly of the present invention comprises a cover with a peripheral rim portion which fits into a bulkhead aperture in a clothes dryer and seats in and removably attaches thereto by resilient locking tabs extending rearwardly from the cover rim. Two of the locking tabs are compound tabs each having both an outwardly-extending shoulder to engage a bulkhead surface and an inwardly-extending barb spaced adjacent the rear surface of the cover to capture a peripheral flange of a flexible frame of the lint filter. The filter in its unflexed state is engaged by the barbs but may be compressed transversely by an operator's hand to disengage the flange from the barbs for disassembly of the filter from the cover and cleaning of the filter. The non-compound tabs may be of a metal material fastened to the cover rim as by rivets, or they may be formed integrally with the cover material.

DESCRIPTION OF THE PREFERRED EMBODIMENTS

Figure 1:
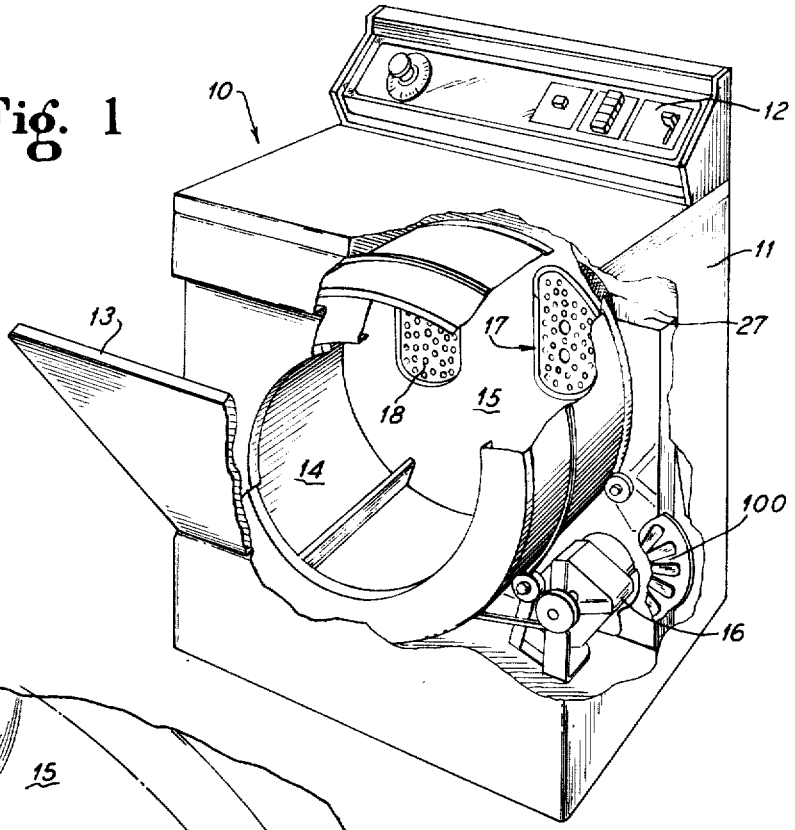
FIG. 1 is a general view of a clothes drying machine incorporating the present invention, with parts of the cabinet cut away to show the internal features of the machine.
Figure 2:
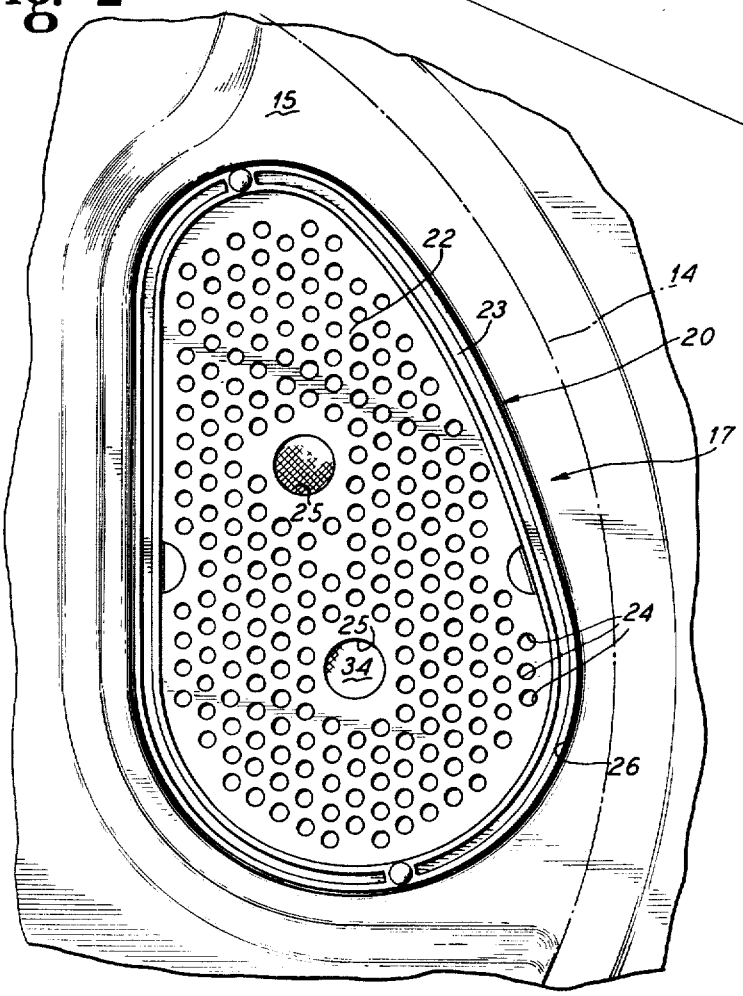
FIG. 2 is an enlarged fragmentary view of the lint screen assembly of the present invention installed in the rear bulkhead of the dryer drum.

In FIG. 1 an automatic clothes dryer is shown generally at 10, comprising a cabinet 11 having a control panel 12 and a door 13 which opens to give access to the interior of a drying chamber shown here as a rotatable drum 14. The drum 14 is of the type cooperating with a fixed rear wall or bulkhead 15 which does not rotate with the drum 14 under action of a motor drive unit 16. A filter assembly or internal lint screen assembly 17 is mounted in an upper portion of the rear bulkhead 15. Temperature-conditioned air is drawn into the rotating drum 14 from an air inlet 18 and removes moisture from the clothing within the drum 14 and then exits in a substantially axially direction through the line screen assembly 17, thereby providing good flow and circulation of air and efficient drying action.

The temperature-conditioned air is ambient air which has been heated by a heater means (not shown), which heater means may comprise, for example, an electrical resistance heating element. The heater means is located in a heater box (not shown) behind the bulkhead 15 adjacent the air inlet opening 18 in the bulkhead. An air exhaust duct 27 is also located behind the bulkhead and communicates, at its upper end, with the interior of the drum through the filter assembly 17. A blower 100, driven by the motor 16, is positioned at the lower end of the exhaust duct 27 and is operable to draw ambient air along a path past the heater means, into the drum through the inlet opening, through the drum to the lint screen assembly, through the lint screen assembly to an exhaust duct, and through the exhaust duct to be exhausted through a discharge opening (not shown). It is the purpose of the filter or lint screen assembly 17, of course, to collect foreign matter, such as lint or the like, from the stream of air passing through the dryer so as to prevent such foreign matter from collecting in the machine or in ducts connecting the dryer discharge to the outside. Absent such filtering the accumulation of foreign matter could result in reduced dryer efficiency or even present a fire hazard. It will be appreciated by those skilled in the art that the dryer structure just described is well known, and further detailed description will therefore be omitted.

The filter assembly or lint screen assembly 17 comprises principally a cover unit 20 and a filter unit 21. The cover 20 comprises a flat apertured wall portion 22 and a rim portion 23. A plurality of apertures 24 through wall portion 26 pass both moist air and lint carried therein. The wall portion 22 also is provided with a pair of finger-grip apertures 25 which are of a size and spacing suitable for insertion of two fingers or one finger and the thumb of an operator's hand for convenient manipulation of the lint screen assembly. Specifically, these finger-grip apertures facilitate removal of the filter assembly 17 from the bulkhead through the application of an outwardly directed force thereto, and also facilitate handling of the assembly and cover.

Figure 3:
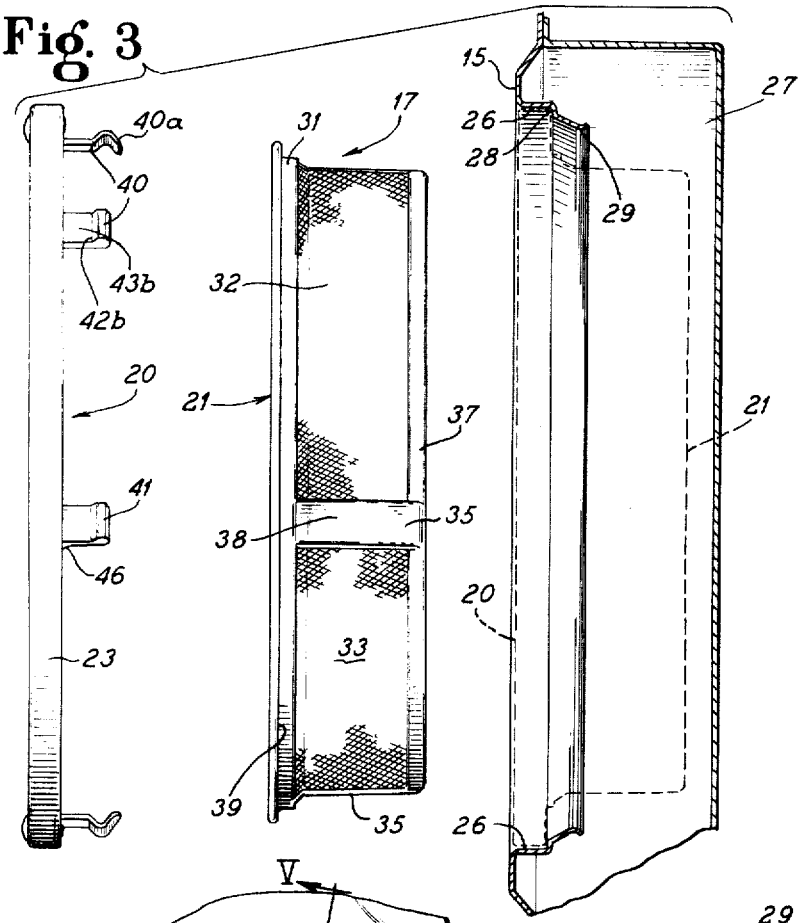
FIG. 3 is an exploded side view of the cover and lint filter of the present invention, showing their relation to the bulkhead opening.
Figure 4:
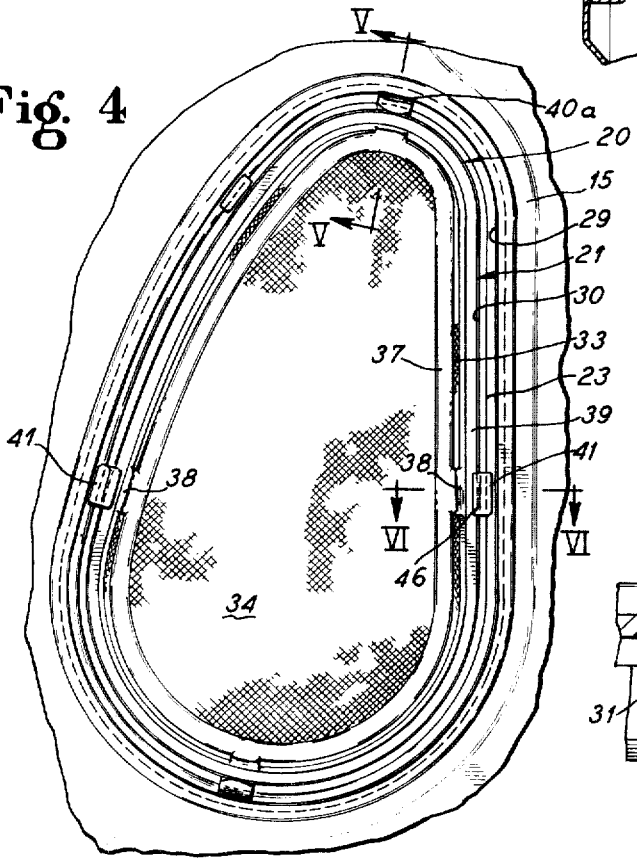
FIG. 4 is a rear view of the lint screen assembly installed in the bulkhead of the dryer.
Figure 5:
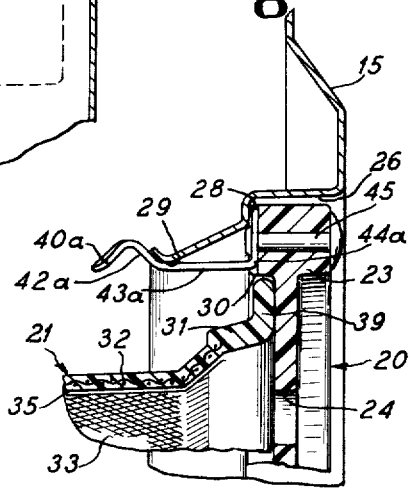
FIG. 5 is a cross-sectional view on line V—V of FIG. 4, showing a metal locking tab riveted to the rim of the cover.
Figure 6:
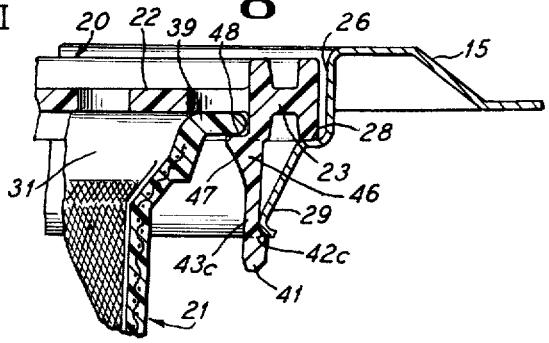
FIG. 6 is a cross-sectional view on line VI—VI of FIG. 4, showing the compound locking tab of the present invention.

The rim 23 of the cover unit 20 has a rounded shape conforming to the shape of the passage or aperture defined by wall means (here shown as the wall portion 26) through the bulkhead 15 into the air exhaust duct 27. Rearwardly of the wall portion 26 is an inwardly-projecting shoulder 28 and a curved engagement surface 29, as shown in FIGS. 3, 5, and 6.

Receivable within and adjacent the inner periphery 30 of the rim portion 23 of the cover 20, against the rearwardly-facing surface of wall portion 22 is a frame 31 of the lint filter 21. This frame 31 is formed integrally with a filter element shown as a screen 32 of a fine mesh size which passes air readily but captures or collects lint carried in the air. The screen 32 is formed with side walls 33 and a rear surface 34. The walls 33 are reinforced by reinforcing ribs 35 while the joint between the walls 33 and 34 is sealed and supported by a web 37. These ribs and web 35 and 37 together with the frame 31, give the lint filter 21 a firm but flexible shape. Preferably the screen 32 is of a metal wire, plastic, or fiber glass material and the ribs and web 35 and 37 and the frame 31 are of a plastic material. Two of the opposite and transversely-spaced side wall ribs 35 of filter 21 include about a hand's breadth apart, manually grippable compression surface 38,38 which are responsive to inwardly-directed forces for deforming the frame 31 inwardly. These surfaces or pads 38,38 allow inward deformation of the frame 31 of the lint filter 21. The frame also has a radially outwardly-projecting attachment flange 39 in contact with the cover's rearwardly-facing surface 22 to afford an engagement surface.

Figure 7:
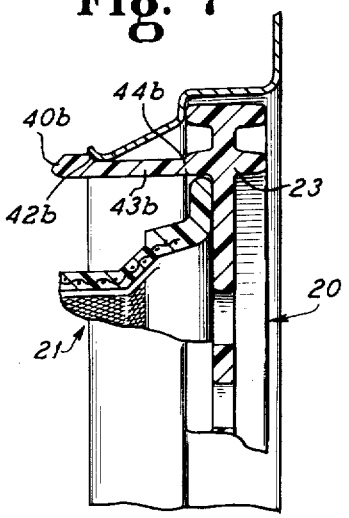
FIG. 7 is a view similar to FIG. 5 but shows an alternate integral embodiment of the non-compound clips of the present invention.

Formed in or attached to the rear surface of the rim 23 of the cover 20 are a plurality of discrete elongate locking tabs, of which some are of a single-acting type 40 and two of which are of a compound type 41, in accordance with the principles of the present invention. The tabs 40 may be of a metal material and mechanically fastened to the cover 20 as shown at **40*a*, or of an integral construction, as shown at 40*b*. Each of the single-acting tabs 40*a* or 40*b* of which three are shown in the drawings, has a radially-outwardly projecting shoulder 42*a* or 42*b* near the free end of a flexible shaft portion 43*a* or 43*b*. The shaft portion 43*a* or 43*b* is sufficiently flexible to allow the shoulder portion 42*a* or 42*b* to be cammed inwardly by the surface 29 of the bulkhead 15 during insertion of the lint screen assembly 17 into the bulkhead 15. Further, the tabs 40*a*, 40*b*, and 41, being resilient as already indicated, may be outwardly biased with respect to the cover 20 so that the cover is held firmly in place within the aperture against the wall portion 26. The forward end of each of the locking tabs 40 is affixed to the rim 23. In this embodiment the metal tabs 40*a* are fastened by means of an up-turned portion 44*a* which is connected to the rim 23 by means of a rivet 45. It will be understood that other convenient fastening or adhesive means could be employed instead of the rivet 45. In the alternative embodiment shown in FIG. 7, the single-acting tab 40*b* is of a plastic material formed integrally with the rim 23 of the cover 20. The forward end 44*b* of the locking tab 40*b* is continuous with the material of the rim 23**.

In accordance with the principles of the present invention, two double-acting or compound locking tabs 41 are provided on the rear surface of the cover rim 23 in positions adjacent the compression surfaces or pads 38,38 on the lint filter 21 when the filter 21 and the cover 20 are assembled together. Each compound locking tab 41 has not only an outwardly-projecting shoulder **42*c* at the free end of a flexible shaft portion 43*c* forwardly thereof to provide a spring action to the shoulder, but an inwardly-projecting barb portion 46 having an inwardly and rearwardly-facing ramp surface 47 and a forwardly-facing shoulder 48. The shoulder 48 is spaced from the rear surface of wall portion 22 of the cover 20 a distance sufficient to capture within the space the attachment flange 39 of the frame 31 of the lint filter 21. Only a small width of the flange 39 is captured beneath the shoulder 48 of the barb 46, so that only a relatively slight inward deformation of the lint filter 21 via the compression surfaces 38 is required to disengage the filter 21 from the cover 20**.

In operation, the rear bulkhead 15 of the dryer 10, within the rotatable drum 14, is accessible to an operator through the access opening exposed by the door 13. The internal lint screen assembly 17 is normally snap-locked to the bulkhead 15 in the position shown in FIG. 1 with the wall portion 26 and the shoulder 28 of the bulkhead providing a seat therefore. The operator opens the door 13, reaches through the drum 14 and inserts a finger into each of the apertures 25 in the wall portion 22 of the cover 20, and with a gentle but firm pulling motion applies an outwardly-directed force to dislodge the shoulders **42*a*, 42*b*, and 42*c* from engagement with the engagement surface 29 of the bulkhead 15. The assembly 17** may then be withdrawn from the machine for cleaning.

Once the assembly is removed from the machine, the cover 20 may be grasped in one hand by the apertures 25 and two fingers i.e. one finger and the thumb of the operator's other hand may compress the frame 31 of the lint filter 21 at the pressure surfaces 38,38, withdrawing one or both of the portions of the flange 39 captured under the shoulders 48 of the barbs 46 on the two compound locking tabs 41. The filter 21 may be emptied of lint collected therein, holding it still by the pressure surfaces 38 or in any other convenient manner.

Reassembly and reinstallation is also a simple process. The lint filter 21 is brought into proximity with the rear surface of the cover 20 and a steady pressure is applied to the rear surface of the filter 21 and/or the frame 31 is distorted inwardly by pressure on the pressure points 38,38 to move the flange 39 past the ramp surfaces 47 of the barbs 46 of the compound locking tabs 41 and into engagement with the shoulder portion 48 thereof. Then the assembly may again be grasped by means of the apertures 25 in the cover 20 and reintroduced into the dryer drum 18. The assembly is aligned with the walls 26 which define the aperture leading to the exhaust duct 27 and the assembly is then pushed gently into the opening until the rear surface of the rim 23 of the cover 20 is seated against the shoulder 28 and the shoulders **42*a*, 42*b*, and 42*c* have snapped outwardly to their holding positions behind the surface 29**. The lint screen assembly is then ready to capture lint from the next load of clothing to be dried.

Although various modifications might be suggested by those versed in the art, it should be understood that I wish to embody within the scope of the patent warranted hereon all such modifications as reasonably and properly come within the scope of my contribution to the art.

Having described the invention, the embodiments of the invention in which an exclusive property or privilege is claimed are defined as follows:

1. In an internal lint screen assembly comprising a cover and a separable lint filter for use in an automatic clothes dryer, a plurality of discrete elongate locking tabs spaced about the periphery of the cover and each having outwardly-extending projections removably securing the assembly to adjoining walls of an air exhaust aperture, at least two of said tabs being compound tabs also having inwardly-extending barbs releaseably engageable with a flange of the lint filter.

2. An internal lint screen assembly as defined in claim 1, wherein all of said tabs are formed integrally with the cover.

3. An internal lint screen assembly as defined in claim 1, wherein at least one of the tabs which are not compound tabs is of a metal material secured by fastening means to the cover.

4. In an automatic clothes dryer having a rotating drum closed at its rear by a fixed bulkhead, the bulkhead having wall means defining an air passage therethrough for exhaust of temperature-conditioned, moistened air and lint from the drum, an internal lint screen assembly received in said passage and comprising:

a lint filter having side walls and a rear wall integral therewith, the walls comprising a fine mesh screen for passing air but capturing lint, and a flexible frame about the side walls opposite the rear wall and having an outwardly-extending attachment flange integral therewith, the side walls having a pair of opposed, manually-grippable compression surfaces adjacent the flexible frame for deforming the attachment flange radially inwardly; and a cover with wall means defining a plurality of apertures capable of passing air-borne lint and a finger grip, and a rigid rim forming an outer periphery of said cover, the rim having on a rearwardly-facing portion thereof a plurality of locking tabs having outwardly-extending shoulders flexibly engageable with the bulkhead, two of the locking tabs on the cover being compound tabs including radially-inwardly extending barbs normally engageable with the attachment flange of the lint filter, thereby to provide an internal lint screen assembly removable from the bulkhead as a whole and with the cover readily removable from the filter for cleaning.

5. An internal lint screen assembly as defined in claim 4, wherein the other of said locking tabs are formed of a spring material secured by fastening means to the cover rim.

6. An internal line screen assembly as defined in claim 4, wherein all of the tabs are integral with the cover rim.

7. A compound locking tab for an internal lint screen assembly of an automatic clothes dryer, the lint screen assembly comprising a lint filter having an outwardly-projecting, transversely-flexible flange about a front edge thereof and an opposed pair of manually-grippable compression points adjacent thereto, and a cover member comprising a flat, perforated wall means and a peripheral rim about said wall means and extending rearwardly of the perforated surface and being of a size and shape to accept the flange of the filter, the compound locking tab being integral with the rim of the cover, extending from a rear surface thereof and having an outwardly-extending shoulder at a free end opposite the cover rim;

a transversely-flexible shaft portion forwardly of the outwardly-extending shoulder; and an inwardly-extending barb portion having a shoulder adjacent the cover rim and spaced from a surface of the wall means of the cover an inwardly distance sufficient to accept between the barb and the surface the flange of the lint filter, thereby to afford removability to the lint screen assembly from the clothes dryer by means of the outwardly extending shoulder of the tab engaging the dryer and removability to the lint filter from the cover by means of the inwardly extending barb engaging the lint filter flange in its uncompressed state.

8. A clothes drying machine having a drying chamber; a fixed bulkhead defining a wall portion of the drying chamber, said bulkhead defining an opening through which air exits the drying chamber; means for providing air movement through the drying chamber and through the bulkhead opening; and a filter assembly removably mounted across the bulkhead opening for filtering lint from the moving air, said filter assembly comprising:

a filter element having a continuous peripheral frame including outwardly-extending flange portions; and a cover including a wall portion defining a plurality of air passage apertures, means for allowing the cover to be gripped for removal of the filter assembly from the bulkhead opening, and a pair of flexible, compound elongate locking tabs fixed to opposite peripheral portions of said cover, said locking tabs each including a free end defining an outwardly-extending shoulder for engaging said bulkhead and a portion adjacent said cover defining an inwardly-extending barb portion for engaging a flange portion of said filter element.

9. A clothes drying machine having a drying chamber; a fixed bulkhead defining a wall portion of the drying chamber, said bulkhead defining an opening through which air exits the drying chamber; means for providing air movement through the drying chamber and through the bulkhead opening; and a filter assembly removably mounted across the bulkhead opening for filtering lint from the moving air, said filter assembly comprising:

a filter element having a continuous peripheral frame including outwardly-extending flange portions;

a cover including a wall portion defining a plurality of air passage apertures, means for allowing the cover to be gripped for removal of the filter assembly from the bulkhead opening, and a pair of flexible compound locking tabs fixed to opposite peripheral portions of said cover, said locking tabs each including a free end defining an outwardly-extending shoulder for engaging said bulkhead and a portion adjacent said cover defining an inwardly-extending barb portion for engaging a flange portion of said filter element;

said filter element includes sidewall portions fixed to said peripheral frame; and wherein each said sidewall portion adjacent a compound locking tab includes a compression surface for receiving an inwardly-directed force, said frame adjacent said compound locking tabs responsive to said forces to facilitate removal of said filter element from said cover.

10. In a clothes drying machine having a drying chamber; a fixed bulkhead closing the rear of the drying chamber, said bulkhead defining an opening through which air exits the drying chamber; and means for providing air movement in a path through the drying chamber and through the bulkhead opening; a lint filter assembly removably mounted through said bulkhead and seated across said opening on surfaces provided by said bulkhead adjacent said opening, said lint filter assembly comprising:

a lint screen having a continuous sidewall portion and an inwardly-deformable peripheral frame attached thereto, said frame including an outwardly-extending flange portion co-extensive with said peripheral frame, said sidewall portion including a pair of opposing compression surfaces for receiving inwardly-directed forces; and a cover including a wall portion defining a plurality of air passage apertures and finger grip apertures to facilitate removal of said filter assembly from said bulkhead opening, a rim portion including a rearwardly-facing surface for seating against said bulkhead surfaces, and a pair of flexible compound locking tabs integral with said rim portion with one of said tabs adjacent each of said compression surfaces, each of said tabs including a free end defining an outwardly-extending shoulder for engaging said bulkhead and a portion adjacent said rim portion defining an inwardly-extending barb portion spaced from an inwardly-facing surface of said wall portion for engaging said flange portion of said frame between said barb portion and said surface of said wall portion, whereby said lint filter assembly is disengaged from said bulkhead in response to an outwardly-directed force applied adjacent said finger grip apertures and said lint screen is disengaged from said cover in response to said inwardly directed forces applied to said compression surfaces.

* * * * *